United States Patent [19]

Sterling

[11] Patent Number: 4,921,247

[45] Date of Patent: May 1, 1990

[54] EXERCISE CHAIR

[76] Inventor: Joseph F. Sterling, 3146 S. Peninsula Dr., Daytona Beach, Fla. 32018

[21] Appl. No.: 895,142

[22] Filed: Aug. 11, 1986

[51] Int. Cl.[5] ..... A63B 21/04

[52] U.S. Cl. ..... 272/136; 272/134

[58] Field of Search ..... 372/68, 93, 134–137, 372/142–144, DIG. 4; 128/25 R, 33

[56] References Cited

U.S. PATENT DOCUMENTS

| | | | |
|---|---|---|---|
| 321,388 | 6/1885 | Ruebsam | 272/134 X |
| 964,898 | 7/1910 | Budingen | 272/134 X |
| 2,690,209 | 9/1954 | Counihan | 272/144 X |
| 2,724,592 | 11/1955 | Pfaus | 272/144 |
| 2,891,538 | 6/1959 | Moxley | 128/33 |
| 3,664,666 | 5/1972 | Lloyd | 272/134 |
| 3,738,649 | 6/1973 | Miller | 272/134 |
| 3,948,379 | 4/1976 | Warner | 128/33 X |
| 3,968,963 | 7/1976 | Sileo | 272/134 |
| 3,985,354 | 10/1976 | Schulkin | 272/142 X |
| 4,089,520 | 5/1978 | Ozbey et al. | 272/136 |
| 4,198,044 | 4/1980 | Holappa | 272/136 X |
| 4,372,553 | 2/1983 | Hatfield | 272/136 X |

*Primary Examiner*—R. Bahr

*Attorney, Agent, or Firm*—William M. Hobby, III

[57] ABSTRACT

An exercise chair apparatus includes a chair having a seat, arms, a back, legs, and a space beneath the seat. The chair back has two or more exercising devices formed therein and has a pair of handles extendible from the devices in the back. The handles are held in cups in the chair back until grasped and pulled from the chair back by a seated person. A head band strap also embodied in the chair back is used for neck exercising and gripping support for abdominal exercises. In each chair arm is located an exercising device that has a handle extendible from the chair arm and recessed in a cup until grasped by a seated person, so that pulling the handles exercises the arms. The chair side panels beneath the chair arms have pulling devices similar to those in the chair arms and are also used to exercise the arms. Rubber caps are formed in the chair arm ends for hand squeezing and gripping support. An extendible tubular frame is attached to the chair frame beneath the seat and can be extended to various distances in front of the chair and an exercising device can be attached thereon for operation by a person sitting in the chair. An adjusting and locking system is provided for moving and locking the extended platform in different positions for the person in the chair, so that a conventional chair can be used as a seat for relaxation or for exercising while in a seated position.

17 Claims, 3 Drawing Sheets

EXERCISE CHAIR

BACKGROUND OF THE INVENTION

The present invention relates generally to a chair apparatus and specifically to a chair incorporating an exercising apparatus therein.

In recent years, the increase in urbanization and mechanization of society has led to a corresponding decrease in the amount of physical exercise in which members of our society regularly engage. Physicians and physical fitness experts have been generally concerned with the public health, and especially with the relationship between good health and a regular program of vigorous physical exercise. This problem is more acute in the case of the urban dweller who typically resides in an apartment or limited space dwelling and works during the day in an office, mostly in a seated position. Thus, the nature of most individuals' employment activities limit his daily physical exercise, while the limited space in the home and surroundings reduces the opportunity to obtain a positive exercise program from daily activities. In an effort to provide home facilities for rectifying the lack of an area to exercise, various knock-down and collapsible exercising apparatus have been proposed. In the past it has also been proposed to provide various exercise gyms to which a person may join as a member by paying a membership fee and regular payment or usage fees.

A prior apparatus for home use have generally not been satisfactory in that collapsible devices are unattractive and must be stored out of sight when the room is to be used for day-to-day living or entertainment. Devices which store the exercise apparatus in furniture require a number of steps to set up the device and are bulky or cumbersome. Most prior art devices do not provide an attractive piece of furniture which can be used at all times as a piece of furniture, and in which the individual can have an exercise program without moving from his chair or from the front of the television set or other entertainment in his home.

The present invention is specifically directed towards a chair which can be used for watching television, relaxing or reclining, but in which the individual can perform a complete exercise program while sitting in the chair and watching television, listening to music, or the like. The chair does not have to be set up like prior art collapsible or convertible devices and does not require the seated person to leave his seat to set up and perform the different exercise routines.

Typical prior U.S. patents can be seen in the Miller Pat. No. 3,738,649 for a combined chair and exercising device in which a chair has a space beneath the seat portion with exercising devices mounted on a platform. The platform can be pulled forward from the chair to allow pedaling and pulling or other usage of the, exercise devices attached to the platform. The Propst Pat. No. 4,452,449 shows an office seating system which incorporates physical activity features to allow the individual to exercise while seated in an office job. The Moyer Pat. No. 2,786,512 shows a therapeutic chair with a tilt top to convert to an exercise table. Snyder, Jr. et al., U.S. Pat. No. 3,893,667 shows an exercise device with combined spring tension and frictional resistance formed into a stool and convertible to a plurality of exercising devices. Chavin, et al., U.S. Pat. No. 1,973,945 shows a combination exercising and massaging apparatus in which an exercise chair can be converted to a table or to various exercising positions and devices. The Pilates Pat. No. 1,969,901 shows a chair convertible to various exercise positions and devices. The Wilson Pat. No. 881,521 for a mechanical chair which is converted into a variety of exercising devices such a a rowing exerciser. The Caldwell Pat. No. 414,675 for an exercising chair with a tiltable back for performing certain exercise routines.

In contrast to these prior art devices, the present exercising chair is a conventional chair with a multitude of exercising devices incorporated into the back, arms, side panels and beneath the chair for use by a seated individual without moving from the chair and for providing a complete exercise routine without leaving the chair and while watching television, listening to music or other entertainment, but which also serves as a standard living room chair, before and after the exercise routine.

SUMMARY OF THE INVENTION

An exercise chair apparatus includes a chair, such as a recliner type chair, having a seat, arms, back, legs and a space beneath the seat. The chair back has a pair of exercising devices formed therein and out of sight except for the handles which protrude from the back and are held in cups formed in the chair back when not in use. The handles are extendible from the back when pulled against springs positioned in tubes in the back. A similar exercise device is located in each arm of the chair and has a handle extending therefrom and held in a cup in each arm when not in use. Each handle is extendible from each chair arm against the spring pressure of a spring mounted in the arm when pulled by a person seated in the chair. An extendible frame is attached to the legs and chair frame beneath the seat and extends from under the seat to the front of the chair and then an exercising device, such as a set of pedals, can be attached to the frame for operating by the person sitting in the chair when the platform is extended from under the seat to the front of the chair. The adjusting and latching means allows the extendible frame to be moved and locked in different positions for different individuals to operate the foot pedals. In addition, the chair has a pair of exercising devices extending from the sides of the chair with handles positioned in cups mounted in the sides of the chair and has a head band strap mounted in the chair back, for gripping with both hands when lifting or manipulating the legs in abdominal exercises and exercising neck and upper torso. Rubber caps are formed in the chair arm ends for hand squeezing and gripping support. The extending platform may be formed with a telescoping tubular frame and attaching a support frame thereon and a latching mechanism which allows a handle to be gripped on the right side of the chair and dropped into any catch in a slotted rack mounted adjacent the telescoping frame. Lifting the handle allows the frame to be slid back under the chair and covered with the front panel.

BRIEF DESCRIPTION OF THE DRAWINGS

Other objects, features and advantages of the present invention will be apparent from the written description and the drawings in which.

DESCRIPTION OF THE PREFERRED EMBODIMENTS

Figure 1:
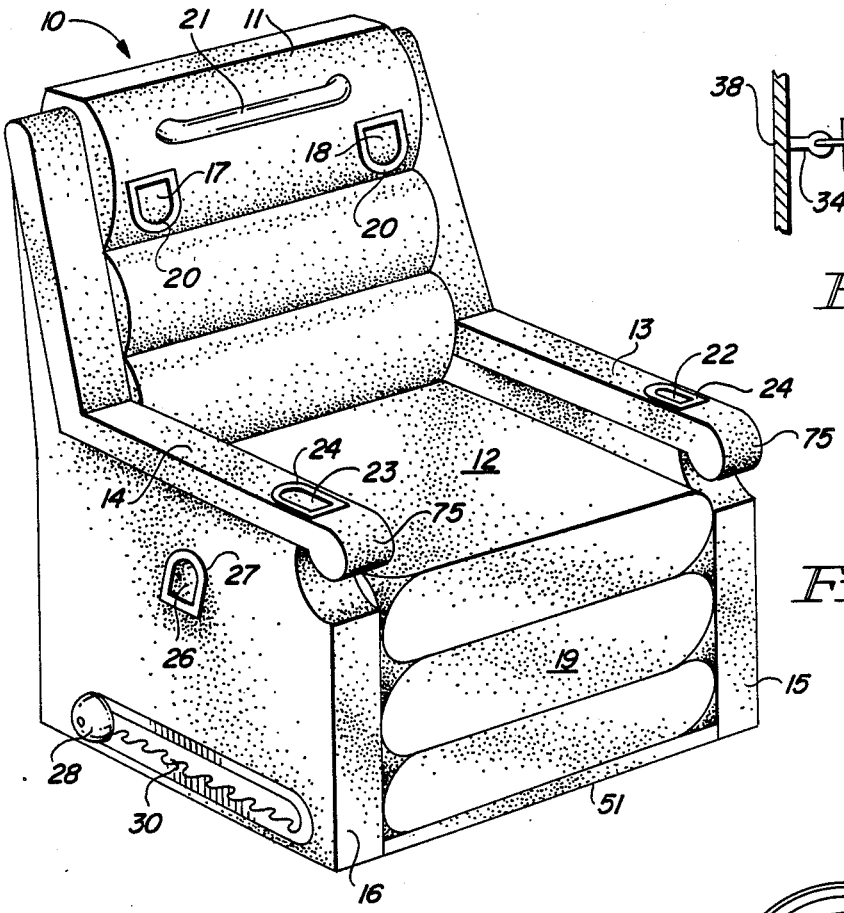
FIG. 1 is a perspective view of an exercise chair in accordance with the present invention.

Referring to the drawings and especially to FIG. 1, a recliner type chair 10 is illustrated as having a back 11, a seat 12, arms 13 and 14, legs 15 and 16 and a decorative front panel 19. A pair of handles 17 and 18 may be seen recessed in cups 20 in the back 11 of the chair 10. Also, a head band type strap 21 is firmly pressed against the back 11 of the chair 10. The chair arm 13 has a recessed handle 22 while the arm 14 has a handle 23 each recessed in a cup 24 formed into the arms 13 and 14. The chair 10 also has a pair of sides 25, each having a handle 26 recessed into a cup 27. At the end of the chair arm 13 and the chair arm 14 is attached to each a rubber formed cap 75. Also seen is the front of the telescoping frame 51 under and behind the panel 19. A handle 28 can be seen on one side 25 of the chair 10 and is fitted in one of the catches 66 of a pawl or rack 30 attached to the side 25 of the chair 10.

Figure 2:
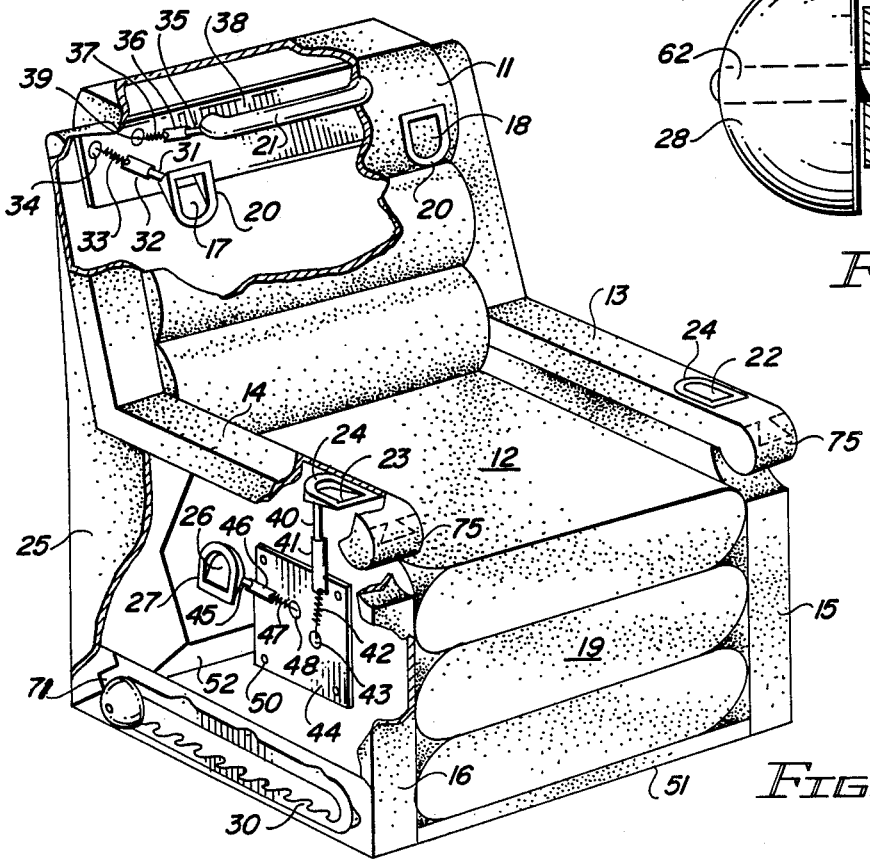
FIG. 2 is a cut-a-way perspective of the chair of FIG. 1 showing the exercising devices therein.

As is more clearly seen in FIG. 2, each handle 17 and 18 is recessed into a cup 20 and has a cord or cable 31 attached to the handle 17 and extending through a tube 32. The cord 31 is attached to a spring 33 which is attached by a fastener 34 to a support plate 38 in the back 11 of the chair 10. Similarly, the head strap 21 is attached on either side to a cable 35 passing through a tube 36 and attached to a spring 37 attached with a fastener 39 to the support plate 38. The head strap 21 may be of a soft cushioned material so that it does not have to be recessed into the chair 10, as in the case of the handles 17 and 18. Pulling the head strap 21 outward and slipping it over the head and resting it firmly against the forehead and then moving the head forward and bowing slightly pulls the cable 35 against plate 37, fastened to a fastener 39 attached to the spring 38. The forward and backward motions provide exercise for the neck and upper torso. The handles 22 and 23 in the chair arms 13 and 14 are each connected to a cable 40 passing through a tube 41 and are connected to a spring 42 which is fastened with a fastener 43 to the support plate 44, so that pulling either the handle 22 or 23 pulls the cable 40 against the spring 42 held by the fastener 43 to act as an exercising device. Each handle 22 and 23 are mounted in cups 24 each recessed into the chair arms 13 and 14 readily available as needed. The handle 26 which is located on either side of the chair 10, is shown in FIG. 2 as having a cord or cable 45 passing in a tube 46 and connected to a spring 47 which in turn is fastened with a fastener 48 to the plate 44. The plate 44 is fastened with fasteners 50 to the frame work of the chair 10. Pulling on either the handles 22, 23 or 26 will pull against a spring riding in a tube to act as an exercising device. The handle 26 is also mounted in a cup 27 recessed in the side 25 beneath the chair arm 13 of the chair 10.

Figure 3:
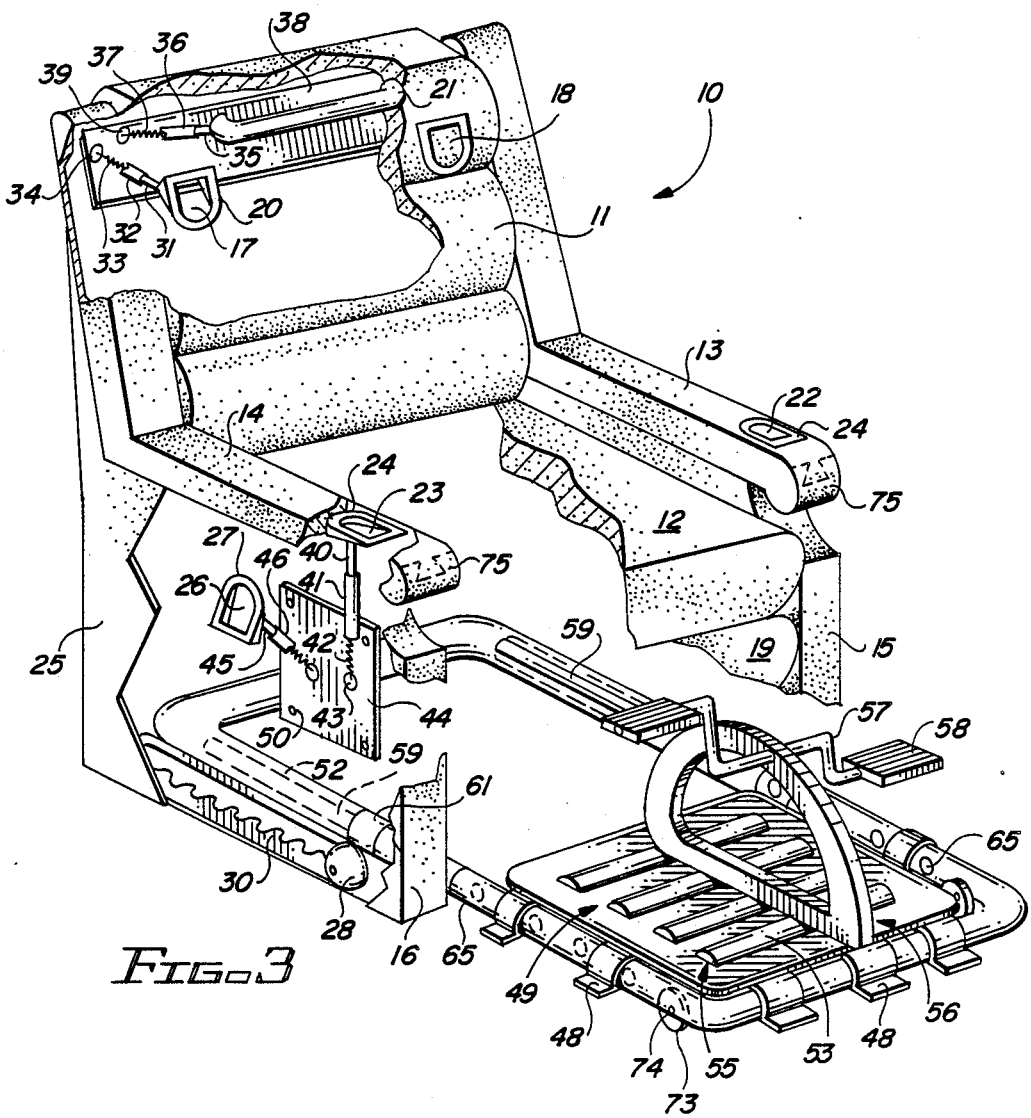
FIG. 3 is a cut-a-way sectional view in accordance with FIGS. 1 and 2 having the platform extended.
Figure 4:
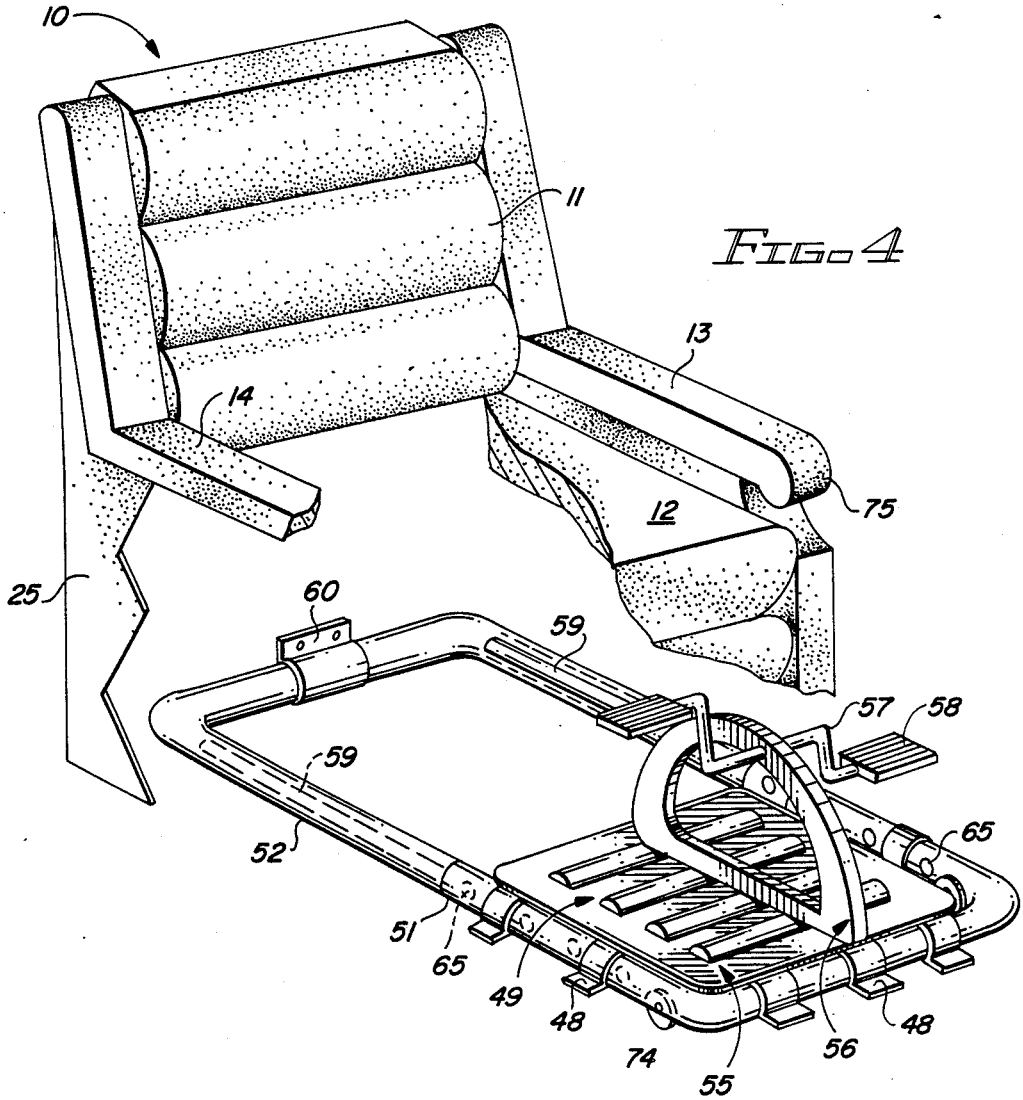
FIG. 4 is a perspective cut-a-way view showing the extending platform.

Referring more specifically to FIGS. 3 and 4, the chair 10 can be seen having a telescoping frame 51, telescoping in a frame 52. The frame 52 is attached to the chair sides frame as well as to the rear, so that it is attached to at least four legs of chair 10 mounted behind the upholstery and beneath the seat 12. The frame 52 is shown having a groove slot 59 in which the guide pins 65 affixed to frame 51 ride, when frame 51 is moved forward or backward by the latching mechanism 30. Proper spacing of the guide pins 65 on frame 51 helps stabilize and facilitate telescoping movement of frame 51 by the latching mechanism 30. The telescoping frame 51 has a support frame platform 49 held thereto with clamps 48. The platform 49 has opened slots 54 formed therein and has an exerciser frame 55 mounted by clamps 48 to platform 49 with the cross members 53 of exerciser frame 55 meshed with the opened slots 54 of frame 49. The exerciser frame 55 has a frame 56 having a pedaling shaft 57 mounted thereto and a pair of pedals 58 for rotating the shaft 57 in the frame 56. The frame 52 can be seen as supported by supporting brackets 60 anchored to the back of the chair 10 as seen in FIG. 4.

Figure 5:
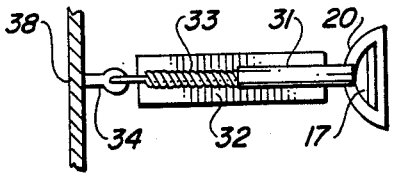
FIG. 5 is a sectional view showing one of the side handle exercising devices.

Turning to FIG. 5, one of the exercising handles 17 is shown connected to a cable 31 connected to a spring 33 which is connected to a fastening eyelet 34 formed in the plate 38. The tube 32 guides the spring 33 and prevents it from engaging or catching into anything in the back 11 while holding the handle 17 in position in its cup 20 in the back 11 of the chair 10. Each of the other handles 18, 22, 23 and 26 are each operated in the same manner as the one illustrated in FIG. 5.

Figure 7:
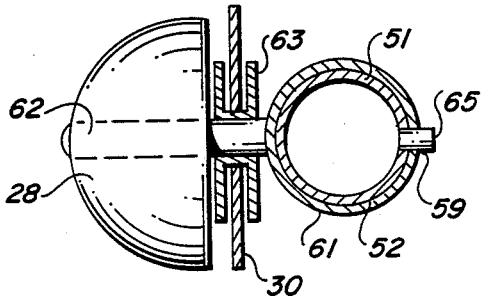
FIG. 7 is a sectional view taken on lines 7—7 of FIG. 2.
Figure 6:
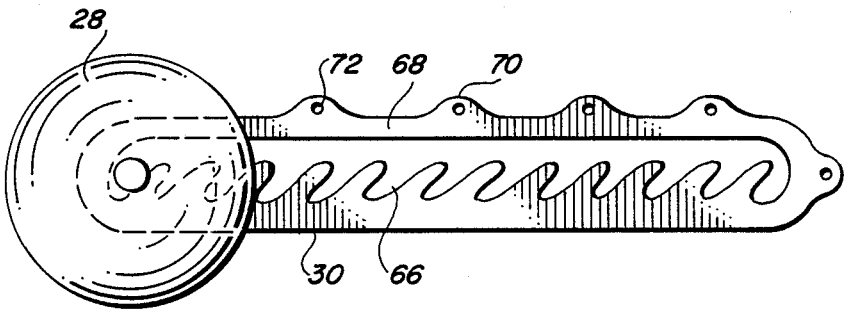
FIG. 6 is a side sectional view of the latching mechanism for the extending platform of FIGS. 1 through 3.

FIGS. 6 and 7 more clearly illustrate the operation of the latching mechanism 30 for moving and latching the extendible frame 51. The frame 52 in which frame 51 is telescoping, has a handle 28 connected to a shaft 62 which has a roller 63 mounted thereon. The shaft 62 has a band ring 61 affixed to its end. The band ring 61 encircles the frame 52 and is positioned between two guide pins 65 on frame 51. Pulling the handle 28 up to remove the roller catch 63 on the shaft 62 out of a recessed latched position 66 in the rack 30 allows the shaft 62 and the roller catch 63 to slide or roll in the opening above the latching position 66. At the same time, the band ring 61, at the end of shaft 62 is encircled around frame 52 and positioned between two guide pins 65.

When the handle 28 is moved the band ring 61 simultaneously moves the telescoping frame 51 in or out of frame 52 as desired. When the desired position of frame 51 in front of the chair 10 is reached, the handle 28 can be pushed down with the roller catch 63 dropping into an aligning latching position 66 and the exercise position is latched as shown in FIG. 6 or fully opened as shown in FIG. 3. The rack 30 has a frame plate 68 having threaded lips 70 for attaching to the side of the chair frame portion 71 as seen in FIG. 2. Each lip 70 has an aperture 72 passing therethrough for attaching screws or threaded fasteners through the lip 70 into the frame.

Figure 8:
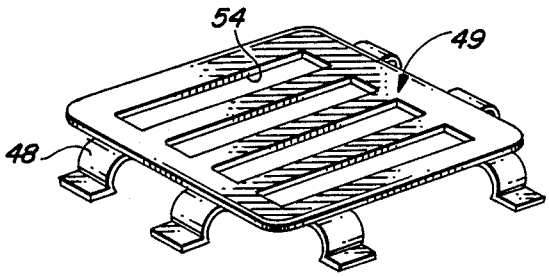
FIG. 8 is a perspective view of the platform support.
Figure 9:
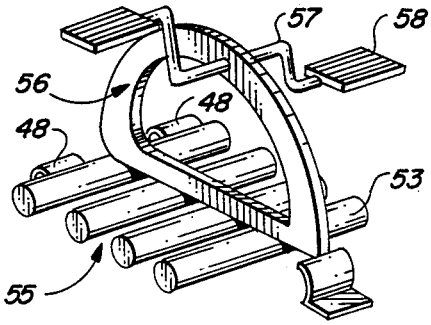
FIG. 9 is a perspective view of the pedaling mechanism to be attached to the platform of FIG. 8 and as shown in FIGS. 3 and 4.

FIGS. 8 and 9 more clearly show the frame 49 having the cross slots 54 and alignment clamps 48 attached therearound for aligning the frame 49 onto the framework 51 and then having mounted the exerciser frame 55 with an exercising frame 56 pedaling shaft 57 and pedals 58. This attachment allows the frame 49 to be easily snapped onto the framework 51 for a quick change of the type of exercising mechanism to be used. The frames 51 and 52 can be mounted very close or onto the floor area below the chair 10 so that wheels 73 can be mounted on pins 74 in the frame 51 to allow it to slide in and out from under the chair and to give it greater support for the exercising pedaling device 56 or other exercising devices attached thereto.

It should be clear at this point that an exercising chair has been provided with a plurality of exercising devices built thereinto but which chair can advantageously be used as an ordinary recliner or other indoor or any indoor/outdoor chair desired. An occupant of the chair can grab anyone of the exercising devices while sitting in the chair and proceed to do various exercises while still watching a television or the like. For instance, handles can be grabbed and pulled against the spring pressure for exercising from the back pulling forward or from the arms pulling upward from the sides of the chair by pulling outward. Alternatively, the head band strap 21 can be grasped by both hands while raising the legs for exercising the abdomen muscles. The head band 21 can also be grasped, if desired, while operating the pedaling exercise device 56. A pair of rubber caps are formed on the end of each arm 13 and 14 for squeezing or grasping while operating the pedaler or for supporting the body while lifting the legs or the back. In addition, the strap 21, which is of soft material, can be slipped over the head and placed against the forehead, moving the head forward and backward to exercise the neck and upper torso.

Accordingly, the present invention is not to be considered as limited to the forms shown which are to be considered illustrative rather than restrictive.

I claim:

1. An exercising chair apparatus comprising in combination:

a chair having a seat, arms, back, legs, sides and a space beneath the seat;

said chair back having a pair of exercising devices therein and having handles extending from the back and held in cups in the back when not in use, said handles being extendible from said back when pulled by a person seated in said chair;

an exercising device located in each arm of said chair and having a handle extending therefrom and held in a cup in each arm when not in use, each said handle being extendible from said chair when pulled by a person seated in said chair;

an extendible frame attached to said chair legs and extendible from under said chair to the front of said chair;

an exercising device attached to said frame for operation by a person sitting in said chair when said frame is extending from under said chair;

means to lock said extendible frame in an extended position, whereby a seated person can relax or exercise different muscles while seated in said exercise-chair; and each of said chair arms has a formed resilient hand grip on one end thereof whereby a seated individual can exercise his hands by compressing the hand grips.

2. An exercise chair apparatus in accordance with claim 1 in which each chair arm has an exercise device located on the side thereof and extendible therefrom and held in a cup in the side of each arm when not in use.

3. An exercising chair apparatus in accordance with claim 2 in which each said arm resilient hand grip is formed of a resilient rubber.

4. An exercising chair apparatus in accordance with claim 3 in which said chair back has a flexible strap attached thereto.

5. An exercising chair apparatus in accordance with claim 4 in which said flexible strap has each end thereof extending into said chair back whereby a person sitting in said chair may grasp said strap with his hands while exercising his legs.

6. An exercising chair apparatus in accordance with claim 5 in which said flexible strap has a spring attached to each end thereof and attached to a support plate mounted in said chair back to allow said strap to be extended during exercising.

7. An exercising chair apparatus in accordance with claim 6 in which said chair back pair of exercising devices has a spring attached to one thereof and attached to said support plate mounted in said chair back.

8. An exercising chair apparatus in accordance with claim 7 in which said exercising device located in each arm of said chair has a spring attached thereto located in each said chair side and attached to a metal plate mounted in each said side arm.

9. An exercising chair apparatus in accordance with claim 8 in which each said exercising device located in each side of said chair has a spring attached to one end thereof and attached to said metal plate mounted in said chair.

10. An exercising chair apparatus in accordance with claim 9 in which said exercise device located in said chair back extends through a sleeve thereby allowing the spring to slide in said sleeve.

11. An exercising chair apparatus in accordance with claim 10 in which each said exercising device located in each arm and in each side has a portion thereof sliding in a sleeve to allow a portion of the spring to slide in said sleeve in said chair arm.

12. An exercising chair apparatus in accordance with claim 11 in which said extendible frame attached to said chair legs has a platform removably attachable thereto having a foot exercising member attached to said platform.

13. An exercising chair apparatus in accordance with claim 12 in which said foot exercising member on said platform is a pedaling device and said platform snaps onto and extendible frame.

14. An exercising chair apparatus in accordance with claim 13 in which said extendible frame has floor wheels thereon to allow said extendible frame to roll from beneath said chair.

15. An exercising chair apparatus in accordance with claim 14 in which said extendible frame has a fixed frame tubing with a smaller tubing sliding therein and includes a slot in said larger tubing with a handle shaft extending therethrough and attached to a handle on the outside of said chair.

16. An exercising chair apparatus in accordance with claim 15 in which said handle shaft passes through a slotted metal plate having a plurality of notches therein for sliding said handle shaft thereinto for locking said extendible frame in an extended position.

17. An exercising chair apparatus in accordance with claim 15 in which said extendible frame fixed tubing has slots therein for pins mounted on said extendible frame to slide in, thereby stabilizing said telescoping frame.

* * * * *